US008757935B2

(12) United States Patent
Ditillo et al.

(10) Patent No.: US 8,757,935 B2
(45) Date of Patent: Jun. 24, 2014

(54) JET GROUTING EQUIPMENT

(75) Inventors: Alessandro Ditillo, Cesena (IT); Maurizio Siepi, Cesena (IT)

(73) Assignee: Soilmec S.p.A., Cesena, Forli-Cesena (IT)

( * ) Notice: Subject to any disclaimer, the term of this patent is extended or adjusted under 35 U.S.C. 154(b) by 0 days.

(21) Appl. No.: 13/148,630

(22) PCT Filed: Feb. 20, 2009

(86) PCT No.: PCT/IT2009/000061
§ 371 (c)(1),
(2), (4) Date: Aug. 9, 2011

(87) PCT Pub. No.: WO2010/095153
PCT Pub. Date: Aug. 26, 2010

(65) Prior Publication Data
US 2011/0311316 A1 Dec. 22, 2011

(51) Int. Cl.
*E21B 7/00* (2006.01)

(52) U.S. Cl.
USPC ..... 405/263; 173/213; 173/184

(58) Field of Classification Search
USPC ..... 405/232, 233, 263, 266, 269; 173/184, 173/213
See application file for complete search history.

(56) References Cited

U.S. PATENT DOCUMENTS

| | | | | |
|---|---|---|---|---|
| 3,552,502 | A * | 1/1971 | Wilson, Sr. | 175/25 |
| 4,659,259 | A | 4/1987 | Reed et al. | |
| 5,036,927 | A * | 8/1991 | Willis | 175/162 |
| 5,135,058 | A * | 8/1992 | Millgard et al. | 175/71 |
| 5,396,964 | A * | 3/1995 | Shellhorn et al. | 175/195 |
| 6,033,152 | A * | 3/2000 | Blum | 405/241 |
| 6,640,451 | B1 * | 11/2003 | Vinarcik | 33/1 PT |
| 6,808,029 | B2 * | 10/2004 | De Lille | 175/52 |
| 7,575,398 | B2 * | 8/2009 | Lloyd et al. | 405/232 |
| 2006/0182594 | A1 * | 8/2006 | Wager et al. | 414/691 |
| 2007/0241742 | A1 * | 10/2007 | Arakawa et al. | 324/207.25 |

FOREIGN PATENT DOCUMENTS

| | | | |
|---|---|---|---|
| DE | 197 31 223 | A1 | 2/1999 |
| EP | 1 045 073 | A | 10/2000 |
| EP | 1 176 283 | A | 1/2002 |
| EP | 1 862 596 | A | 12/2007 |

OTHER PUBLICATIONS

International Search Report for corresponding International Patent Application No. PCT/IT2009/000061 mailed Jul. 1, 2009.

* cited by examiner

*Primary Examiner* — Thomas B Will
*Assistant Examiner* — Jessica H Lutz
(74) *Attorney, Agent, or Firm* — Merchant & Gould P.C.

(57) ABSTRACT

Equipment serves to form consolidated soil columns having a non-circular cross-section, and includes a mast (2, 8), a rotary (3) which is rotatable and translatable along an axis parallel to the mast, a series of hollow rods (4) temporarily unlockable from the rotary (3), and a device to vary the rotational rate of the rotary in one or more prefixed angular ranges. A rotor (21) is directly secured to one of the rods of the string and operatively coupled to a device (20) generating control signals to vary the rotational speed of the rotary in response to the rotor angular position. A through clamp (10) is mounted to the rotatable mandrel of the rotary and is provided with locking members which can be activated to clamp a rod and make it integral to the rotary, and which can be deactivated to release the rod so as to allow the rotary to move relative to the rod.

14 Claims, 11 Drawing Sheets

JET GROUTING EQUIPMENT

This application is a National Stage Application of PCT/IT2009/000061, filed 20 Feb. 2009, and which application is incorporated herein by reference. To the extent appropriate, a claim of priority is made to each of the above disclosed applications.

FIELD OF THE INVENTION

The present invention relates to a jet grouting equipment.

BACKGROUND OF THE INVENTION

The technique called "jet grouting" consists in the consolidation of soil portions by means of injections at very high pressure of cementitious grouts through nozzles arranged at the bottom of a string of tubular rods. Jet grouting systems have been developed over time in order to meet all the needs of the field, and are distinguished for the number of the fluids which are used (only cementitious grout, cementitious grout plus air, cementitious grout plus air and water), and for the operative parameters which change the diameters of the consolidated soil from a few ten centimeters to above 3 m. The methods to carry out the treatment can be classified as: "continuous" or "stepwise".

In the continuous method, the injection mainly occurs by combining the rotational and translational movement of the rods; rotational rate of the rods, ascent rate, flow rates and pressures of the consolidating fluids, are related to the diameter of the column to be created, the resistances required for the consolidated soil, and the jet grouting type selected (single-, double-, or triple-fluid type).

The stepwise withdrawal injection method distinguishes itself from the continuous method since the injection of consolidating grout occurs by alternating steps of only rotating the rod without pulling it out for a preset period of time, to withdrawal steps, performed in order to locate the nozzles to the upper bench. Therefore, the columnar treatment results to be composed of many stepwise consolidated soil "arches". The limitations of this system relate to the part of the instruments on board of the machine, which is more complex, and gives a higher variability in keeping the treatment operative parameters set. On the other hand, the rotary head can be moved in a quicker manner compared to the continuous method. However, the "restart" limitations, related to the head stroke described before, remain unaltered.

In order to perform consolidating operations in the context of using jet grouting techniques, depths ranging between 15 and 50 m are generally reached. The vertical stroke available to the rotary head (defined as "rotary" in the field, since it delivers the drilling torque necessary for the rod to rotate during drilling) is generally not sufficient, since the pieces of equipment of a more widespread size typically have a mast with a length ranging between 4-7 m. Some special jet grouting equipment can have strokes up to 15-18 m, but this involves problems of weight, transportation costs, they require large spaces and well-leveled soils, and assembling times. Furthermore, the drilling machine, which is no more self-erecting, requires an auxiliary crane for all the handling steps of the mast.

Therefore, in order to reach the design depths, it is necessary to add rods to the drill string. However, this is a time-consuming and costly practice, since the operation to add and remove rods involves the risk of introducing soils into the duct, and of consequently causing the obstruction of the same duct.

In some cases, to increase the treatment depths, use is made of mast extensions which allow housing a string of rods much longer than that which the mast on which the rotary slides can house. In this case, the rods are passing "through" within the rotary, which drags them via locking means.

In this case, the drilling and treatment operations are performed in more "restarts" of the rod to reach the designated depths. When the rotary head has reached the topmost point of the guide mast, the so-called "restart" of the rod is performed: the drill string is locked and temporarily overhung by means of a clamp assembly at the mast base. Then, the rotary head performs a downward return stroke, then starting again with a new ascent and injection step (jet grouting).

In some of the main applicative fields of this technology, it is required to create a curtain wall, formed by the combination of partially overlapped jet grouting elements (diaphragm walls for surface excavations, impermeable shields for dams, impermeabilization of joints between adjacent buried panels, weirs). In these cases, the implementation of a series of consolidated soil columns with a horizontal section which is not circular, but instead elongated, typically in the aligning direction of the curtain wall or weir, in order to have a higher level of certainty of an impermeable junction thereof, can be cost-effective. Furthermore, the elongated shape decreases the number of elements needed to complete the diaphragm wall, and consequently the joints needed, the overlapped part of adjacent "columns", with time and cost saving due to the less consolidating material to be injected into the hole.

EP 1 862 596 A1 discloses a system to implement consolidated soil columns with elongated shape composed of a rotary head (or "rotary") which drives upon rotating a string of rods terminating at the ends thereof with an injection head (or "monitor") provided with nozzles for the ejection of the consolidating grouts into the soil. A device, including projecting tabs secured to the rotating part of the rotation head and facing a proximity sensor integral to the rotation head fixed part, allows activating the different treatment modes, by modulating the adjustment of the drilling machine hydraulic circuit, to increment or slow down the rotational rate as a function of the head instantaneous angular position. The horizontal size of the consolidated soil element is as a function of the specific energy of the jet, and consequently (while keeping pressure and flow rate constant) of the time of exposure to the jet. In this case, the time of exposure is given by the rotational rate with which the jet encounters the soil body to be consolidated, beside by the ascent rate. Consequently, the rotational rate is inversely proportional to the specific energy inputted into the soil. High specific energy values allow implementing a higher diameter of treatment.

In EP 1 862 596 A1, the angular position of the nozzles is derived by detecting the rotary angular position. This system loses in precision where angular sliding movements between rotary and rod are generated. Such problem occurs when, due to the need to increase the treatment depth, use is made of mast extensions allowing housing a string of rods much longer than that which the mast on which the rotary slides can admit. In this case, the rods are passing "through" the internal part of the rotary, and no more directly secured thereto. Therefore, the transfer of the drilling movements from the rotary to the rods occurs by interposition of a third member, called through clamp or clamp jet, which receives the rotation from the rotary and transfers it to the rods by means of a clamping system based on wedges which transfer by friction these rotational components to the rod (which usually have a perfectly cylindrical and smooth outer profile).

In some cases, for example under the action of an insufficient clamping by the clamp on the rod, or a loosening of the same clamping due to impacts and vibrations, or due to sudden overloads typical of this type of underground operations, which can instantaneously halt the tool, thus creating a significant inertia on the motion transmission system, or still due to the progressive wear of the toothing located on the wedge surface, in direct contact with the rod, in all these cases, a sliding between rod and clamp wedges takes place, consequently between rod and rotary. It shall be apparent that this drawback does not involve penalizations in the case of cylindrical columns, while with elongated members, an assessment error of the nozzle position, which is instead integral to the rod, generates a column which is horizontally elongated to an undesired direction; this involves an insufficient copenetration and junction of adjacent panels, with consequent loss of impermeability of the underground structure. In those case where such defect is noticed, can be repaired by performing additional drilling operations and curtain wall treatments. Instead, where this defect were not noticed, the structural integrity of the structure to be implemented could be compromised, with a far greater impact on costs.

SUMMARY OF THE INVENTION

The object of the invention is to perform columnar jet grouting consolidating operations having a non-circular section with higher accuracy and depths compared to what can be hereto achieved.

BRIEF DESCRIPTION OF THE DRAWINGS

A few preferred, yet non-limiting embodiments of the invention will be now described. Reference is made to the annexed drawings, in which.

DETAILED DESCRIPTION OF THE PREFERRED EMBODIMENTS

Figure 1:
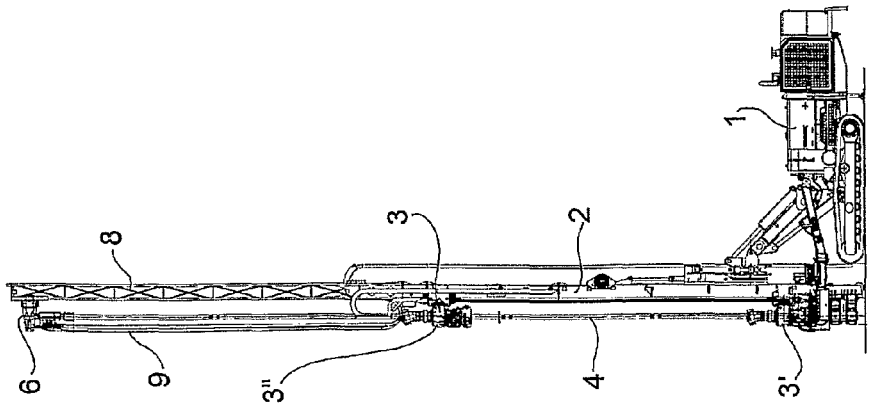
FIG. 1 is an elevation view of an equipment for the implementation of jet grouting consolidation operations.

With reference first to the FIG. 1, a self-propelled vehicle 1 carries a drilling mast 2 (or "mast") erected in the vertical position, along which a rotary 3 slides, illustrated in two positions, lifted (3") and lowered (3'). The rotary serves to transmit the rotation and the sliding movement (pull-push) to a string of rods 4 upon performing a drilling and a jet grouting treatment. The rotary is actuated by an associated hydraulic motor reducer assembly 5. The general structure of the equipment represented in FIG. 1 is to be meant as generally known. Consequently, in the following of the present description only those elements of specific importance and interest to the purposes of the implementation of the present invention will be described in a detailed manner. For the implementation of the parts and elements not illustrated in detail, such as for example the handling means of the rotary head (e.g., the pull-push systems), reference can therefore be made to any jet grouting equipment of the known type.

An upper trolley sliding along the mast 2, and which is capable of extending the movement thereof also to the length of mast extension 8 (generally implemented and herein represented as a trestle) aligned to the base mast 2 is indicated with 6. The mast extension(s) 8 serves the function of extending the guide for the string of rods beyond the length of the base mast 2. This allows starting with the drilling while having a string of rods the overall length of which is higher than the rotary stroke along the base mast 2, to the aim of carrying out a drilling operation at a greater depth. If only the base mast 2 were used, it would be necessary to discontinue the jet treatment carried out during ascent due to the need to remove the rods added during drilling to reach the required depth. Discontinuation of treatment poses both problems in the integrity of the same treatment, and the loss of reference between the angular position of the nozzle (located deeply into the soil, located on the monitor) and the additional rod which is added. The upper trolley 6 supports a supplying head 7 which introduces, by means of hoses 9, fluids and grouts into the upper end of the topmost rod of the string. The trolley assembly 6, as well as the supplying head and the other supplying and pumping means for the several fluids are known in the art, and they need not to be described in detail herein.

Figure 2:
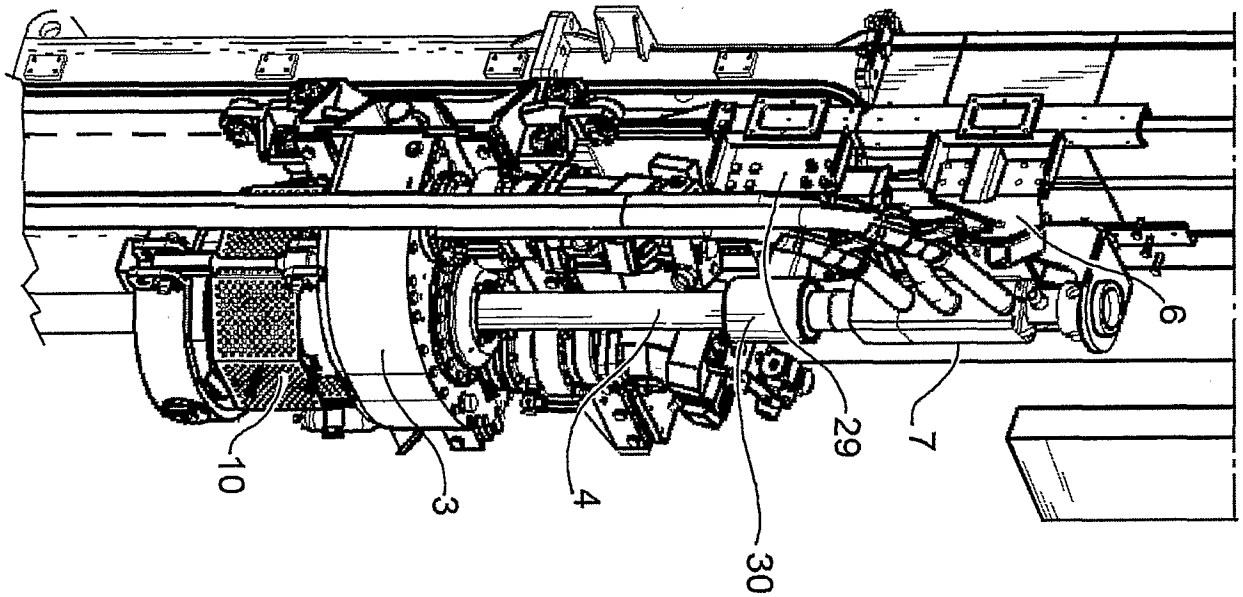
FIG. 2 is an enlarged, perspective view of an assembly comprising the through clamp mounted inferiorly to the rotary, and upper and intermediate guide trolleys.

Sometimes, when the lengths of the base mast and the mast extensions are significant (for example, above 20 m), it is possible to introduce a intermediate trolley 29, represented in FIG. 2, which is arranged between the upper trolley 6 and the rotary 3. The purpose of such trolley is to interrupt the rod free length located above the rotary, thus preventing the dangerous flexures generated on the string by the rotational movements imparted. In order to guide the rod 4, the intermediate trolley 29 is provided with a collar 30 which leave the string freedom of axial and rotational sliding movement.

Figure 3C:
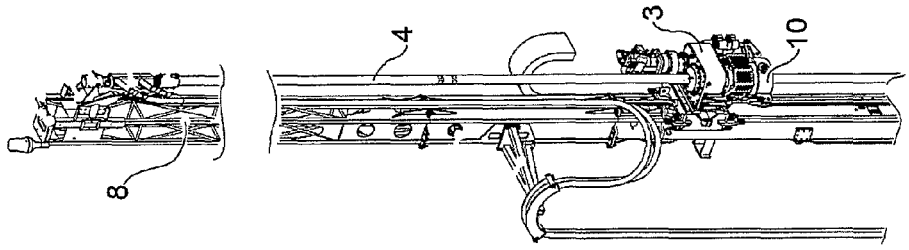
FIGS. 3A-3C are views from different angles, in an enlarged scale, of the top part and the rotary of the equipment in FIG. 1.
Figure 3B:
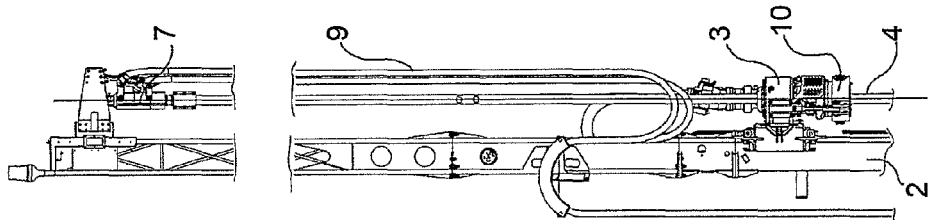
Figure 3A:
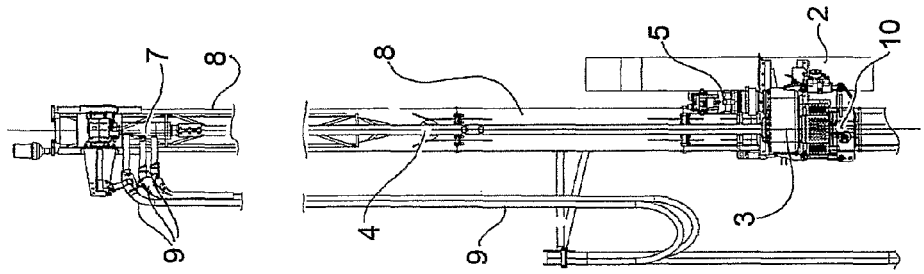
Figure 4:
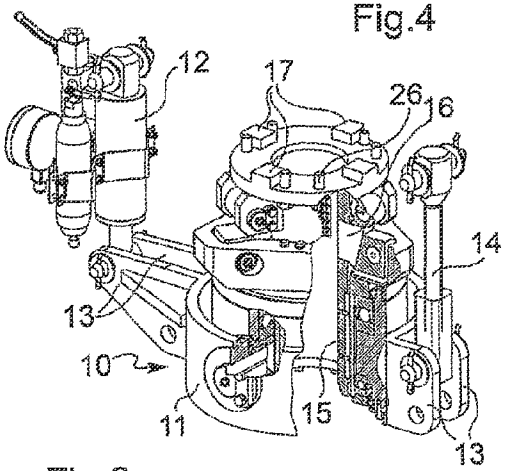
FIG. 4 is a partially sectional, perspective view of a through clamp forming part of the equipment of FIG. 1.
Figure 8:
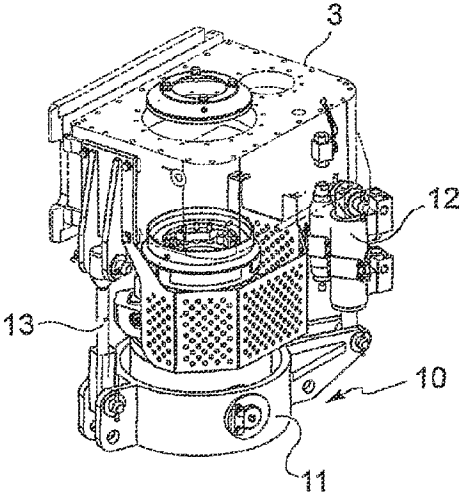
FIG. 8 is a perspective view of the through clamp of FIG. 4 and of the rotary associated thereto.
Figure 5:
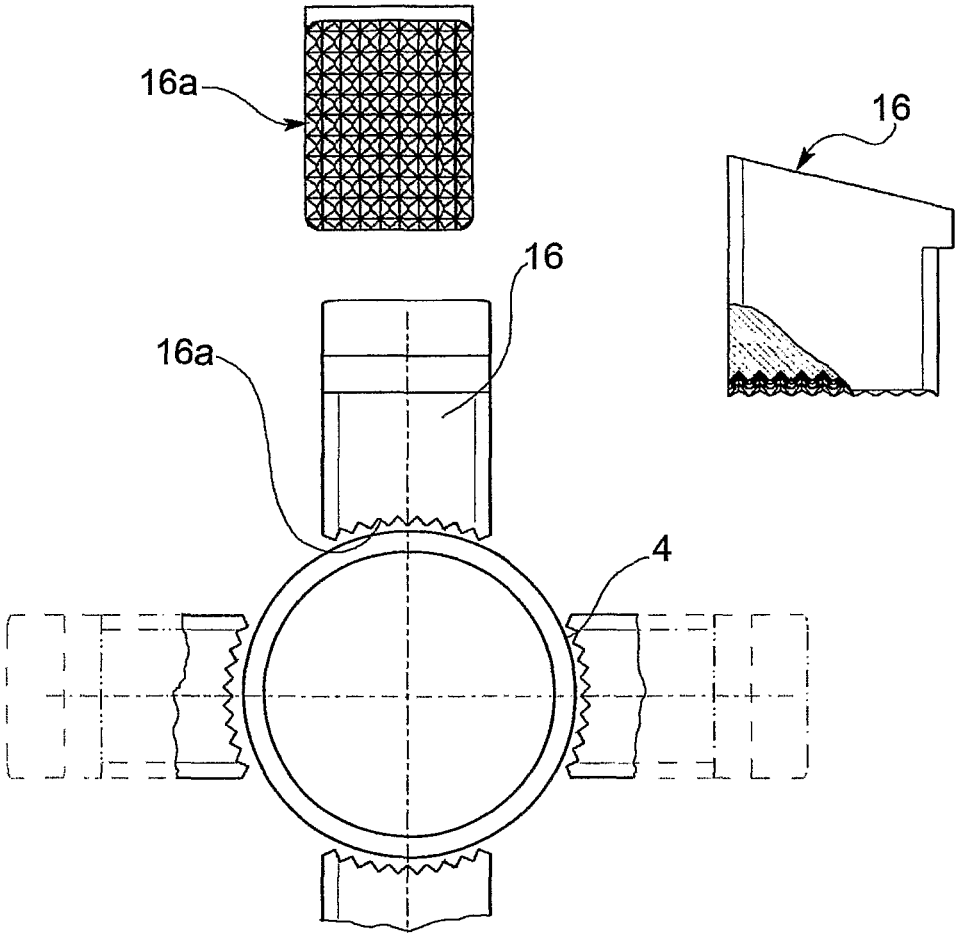
FIG. 5 is a top view and particulars in several views, of the clamping wedges of the through clamp used to drive the rod during the drilling movements.
Figure 7:
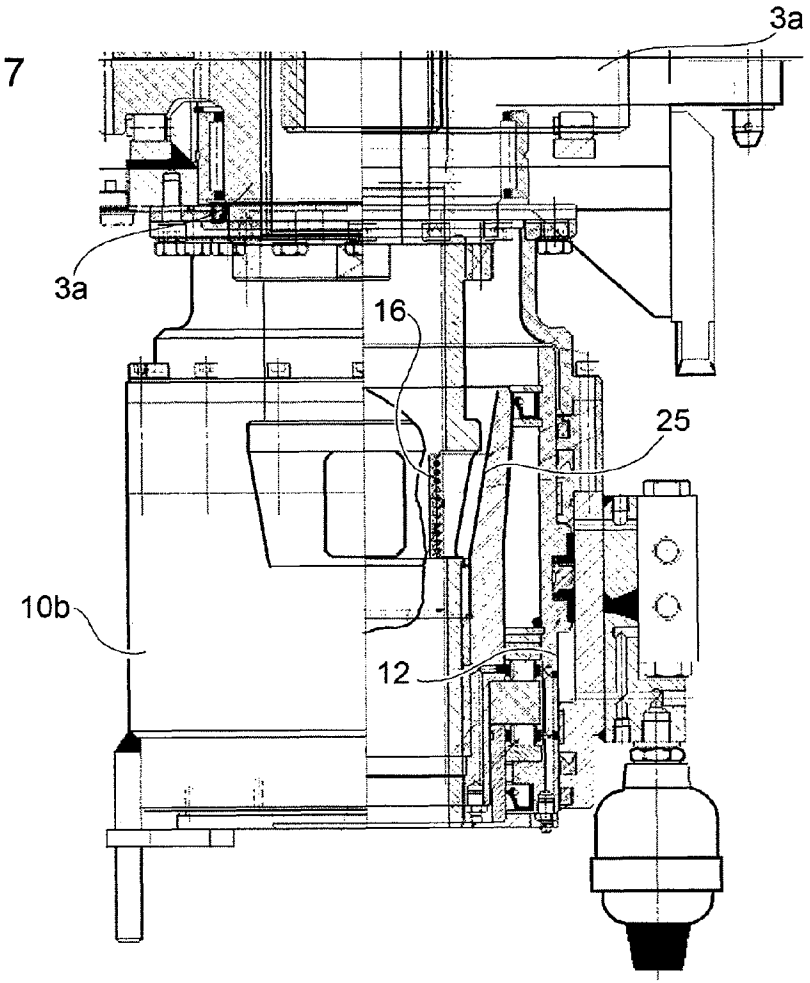
FIG. 7 is an enlarged view of a particular of FIG. 6

A through clamp is generally indicated with 10 in FIG. 4, which is mounted inferiorly to the rotatable mandrel 3*a* of the rotary 3 (dashed in FIG. 3). Function of the through clamp 10 is to make the rod 4 integral to the mandrel 3*a* during all the drilling and jet grouting treatment steps, and to clear the rods from the mandrel 3*a* when the "restart" of the rod has to be performed, and in all the assembling steps of the string, as it will be more clearly understood herein below, when the sequence of FIGS. 12A-12E will be illustrated. The through clamp includes an outer collar 11, liftable by means of a hydraulic jack 12. The collar forms pairs of diametrically opposite ears 13 for the assembling thereof, at one side, to the jack, and at the opposite side to a sliding coupling 14 in the shape of telescopic bars to keep the collar 11 horizontal. This telescopic adjustment becomes necessary since the through clamp is suitable to operate with rods of different diameter, to a maximum value given by the free inner passage which is equal to the inner diameter of the central sleeve 15 of the clamp. The rods of different diameter require different clamping strokes at the jack, and to keep proportionate the efforts and optimized the clamping operations on the rods, the tie bar 14 length is adjusted through the telescopic coupling thereof (e.g., with screw-nut screw systems which are screwed to decrease the length). Lifting of the collar 11 along the central sleeve 15 produces the radial clamping of a series of wedge-shaped blocks 16 (which are radially pushed by wedge-shaped push abutments 25) against the surface of a rod of the string. These wedge-shaped blocks 16 are generally suitable to clamp only one rod diameter, since the surface thereof is designed to enclose at best the rod outer surface, thereby ensuring an optimal clamping between the two members, visible in FIG. 5. Therefore, the different rod diameters used impose the replacement of the wedges 16 with those dedicated to the diameter in use for the treatment. Superiorly, the through clamp has a series of relief formations 17 adapted to couple with corresponding recesses (not illustrated) formed at the rotary side, to transmit the rotational motion therefrom to the clamp. The rod axial movement components are imparted by the rotary to the through clamp via the pushing surface 27 shown in FIG. 4 (push on rod) or the securing screws 26 (withdrawal pull on rod). The through clamp, in turn, imparts the rod axial movement, again via the same wedge-shaped blocks 16 which keep the string locked only by friction between the surfaces in contact 16*a*. To this aim, the surface 16*a* of the wedge-shaped blocks, in contact with the generally smooth cylindrical surface of the rods is so treated as to increase gripping between the two members: for example, the shape can have a toothing (visible in FIG. 5) or pointed inserts promoting the retaining of the rod on the wedge.

In an embodiment alternative to those illustrated, the jacks 12 are two or more than two.

Figure 6:
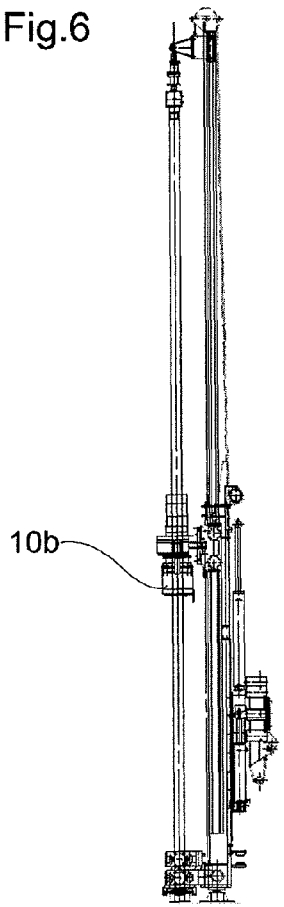
FIG. 6 is a top view of a guide mast with mast extension which is provided with a jack through clamp of a type coaxial with the rods.

In FIG. 6 a through clamp 10*b* is reported, in which the jack 12 is single and coaxial to the rod. In this case, the jack movement (both during opening and during closure, according to the imparted control) causes the axial displacement of the wedge-shaped push body 25 which transmits the radial displacement of the wedge-shaped blocks 16 for the clamping to the rod 4.

Figure 9:
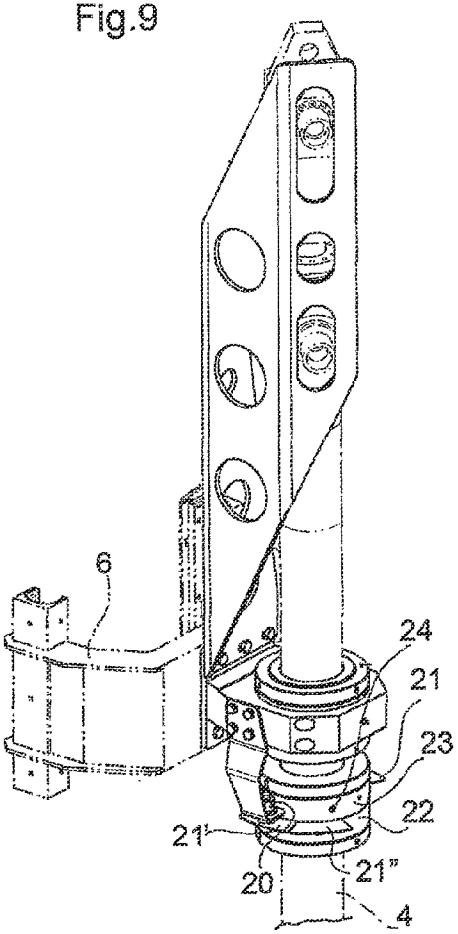
FIG. 9 is a perspective view of a device for detecting the angular position of a rod.
Figure 10:
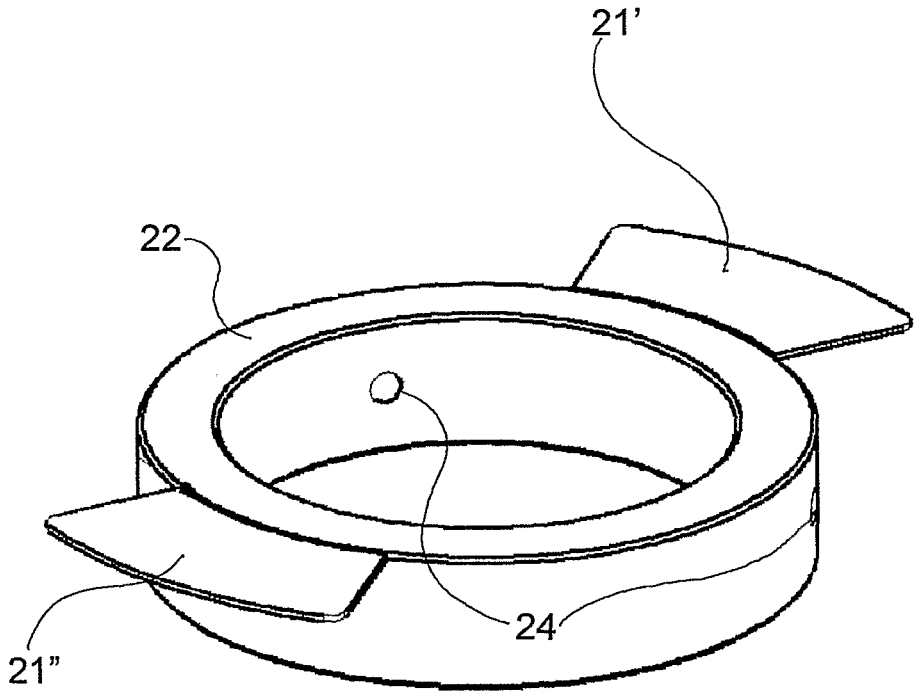
FIG. 10 is a perspective view of a ring integral to the rod which carries the sectors necessary to the activation of the rotation sensor.

In FIG. 9, a device for detecting the rod angular position associated to the equipment is visible. A proximity sensor 20 is firmly secured to the guide upper trolley 6 for the rods; on the rod 4 a rotor 21 with sectors is locked, which in the preferred embodiment is composed of two pairs of opposite angular sectors 21', 21", where each pair is supported by a respective ring 22 (lower), 23 (upper). In FIG. 10 is visible the particular of the ring 22 in which the tubular body has an inner cylindrical cavity adapted to allow the passage of the rod 4 and carries on the perimeter thereof two diametrically opposite sectors 21', 21" which have angular extensions of reduced width, and generally adapted to the type of treatment to be performed. The threaded holes for the insertion off the radial dowels 24 necessary to the angular locking of the ring 22 on the rod 4 are also visible. The rotor 21 is integral to the rod through radial dowels 24 which lock the rings 22, 23 relative to the surface of the rod. This mechanical locking or equivalent systems, or removable locking systems (welding, brazing, glueing operations) establish a precise and safe connection between rod 4 and rotor 21, univocally identifying the angular position of the rod relative to the rotor, thereby relative to the sectors 21', 21". When the rod 4 rotates, the sensor 20 detects the presence (or absence) of the rotor sectors passing in front of it, and generates (or inhibits) an electric signal indicative of the rod instantaneous angular position. This signal is provided to a processing gearcase (not shown) which controls the rotational rate of the rotary, slowing it down when the nozzles are oriented along the axis of the diaphragm wall to be implemented. Vice versa, the rotational rate is increased when the rod is orientated to directions in which a column of a lower thickness is sufficient.

Figure 11:
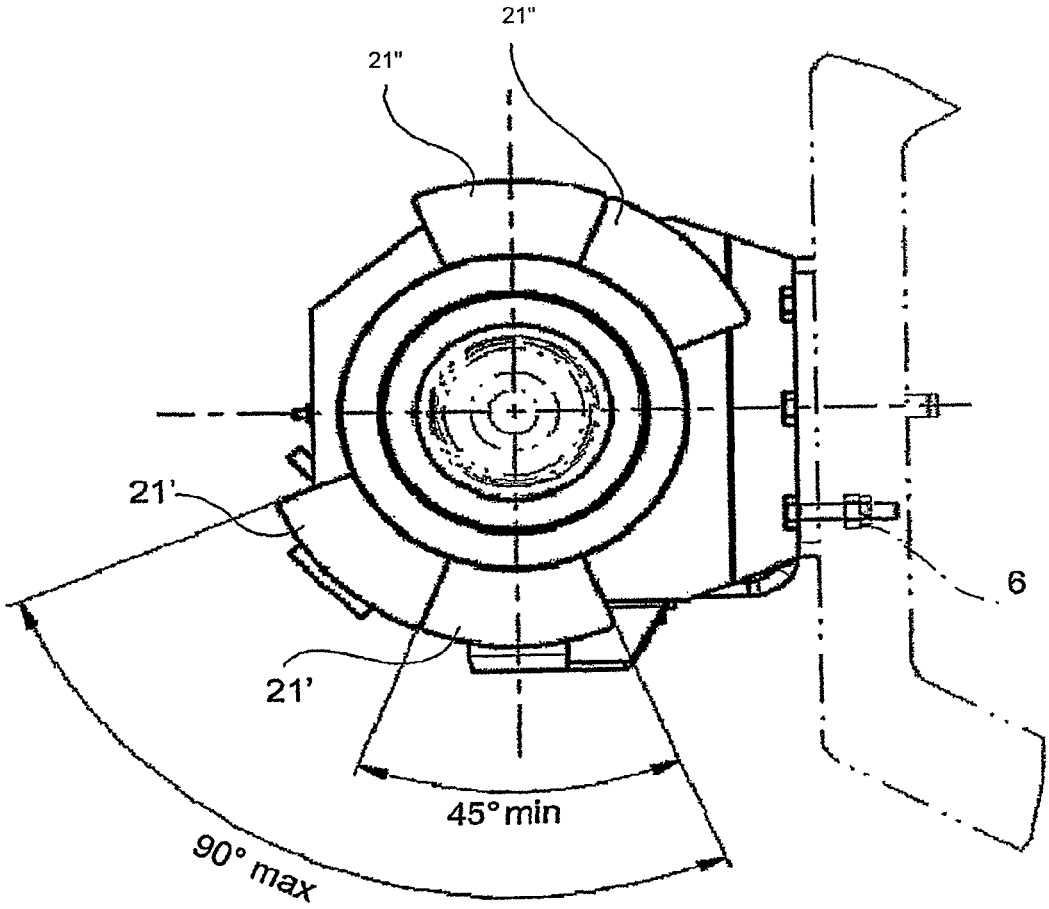
FIG. 11 is a top view of the rotor carrying the rings with the sectors, in which the width adjustment achievable by the relative rotation of the rings can be observed.

Operatively, once the string of rods has been installed, the position of the pairs of sectors 21', 21" is adjusted relatively to the position of the nozzle(s) by acting on the dowels 24. Consequently, the outlet direction of the injection jet relative to the position of the sectors is univocally identified. Therefore, the angular width can then be adjusted by overlapping the sectors of the ring 23 (e.g., 21') to those of the ring 22 (e.g., 21"). As represented in FIG. 11, in a preferred, yet non-limiting embodiment, the sector of minimum width which is equal to 45° is obtained by completely overlapping the sectors 21'. On the other hand, the maximum width extension, equal to 90°, is obtained as represented in the Figure, by maintaining the sectors adjacent. Any intermediate overlapping positions can be used. The width dictates the duration of the length in which the jet has a rate different from that in which the rotor does not have sectors.

Experimental tests performed by the Applicant showed that the theoretical positioning of the sectors has to be "offset" in order to account for the delays in the actuation operations of the machine (generally hydraulic). That is, in relation to the treatment rates (above all for the maximum one, which has to be slowed down to the minimum value) and for the temporal inertia of the actuation systems, an advance of the electric signal is required, with consequent displacement of the first sector, which has to be rotated by several degrees in the opposite direction to the rotation direction of the rods (advance of the signal). It is also required an advance (generally not equal to the previous one) in order to discontinue the jet at the minimum rate, once the required rate has been reached.

Figure 13:
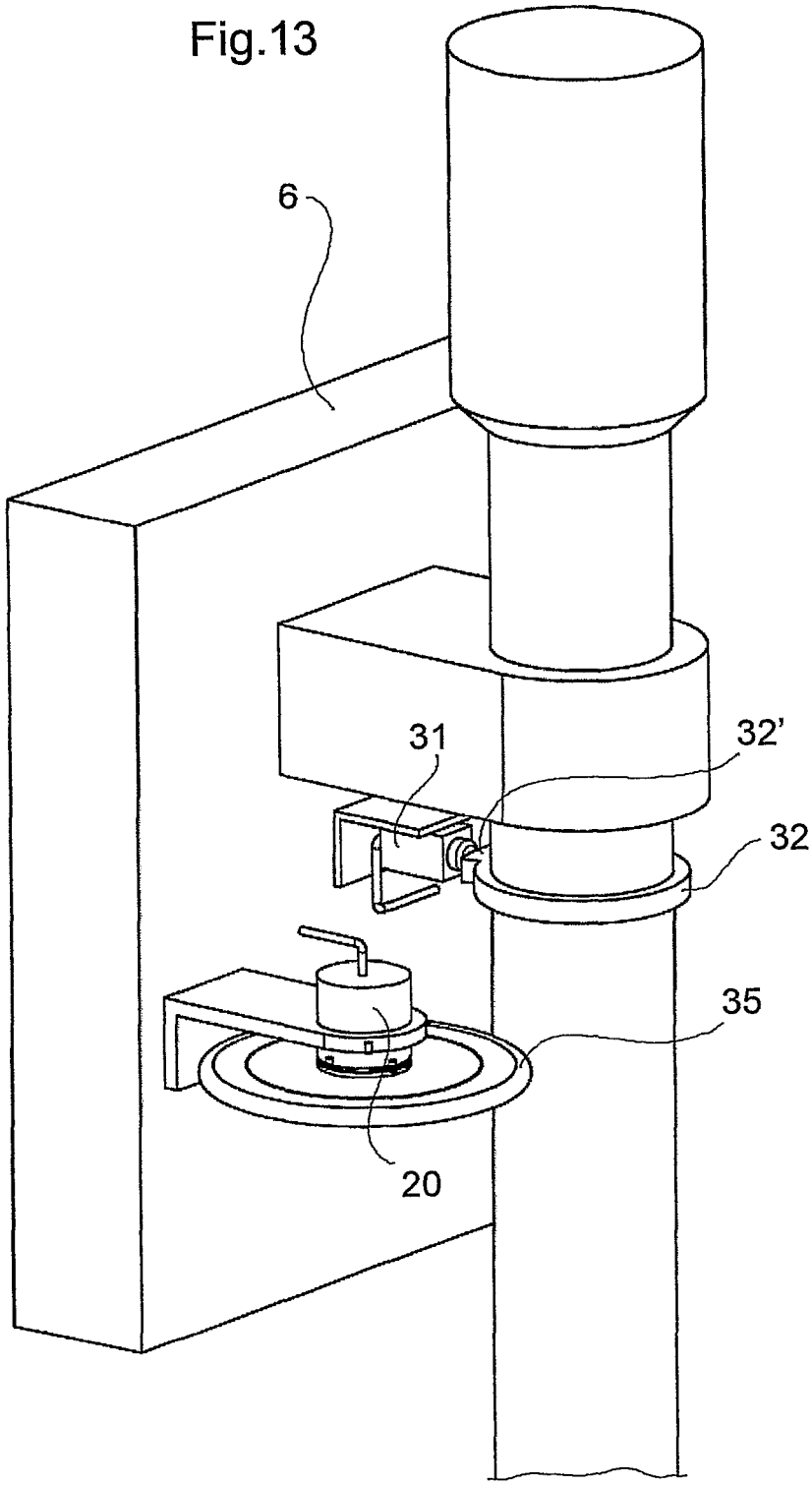
FIGS. 13, 14 and 15 are perspective views of devices for the indirect detecting of the angular position of a rod.

Other detecting means could be used in replacement of that described above, with the aim of converting the angular position of the rods into electric signals. In further embodiments, the rod rotational rate is made to change in a progressive or continuous manner, instead of a discrete manner. For example, in another embodiment (illustrated in FIG. 13), the detecting device includes a friction mechanism, such as for example a rubber roll 35 which is pressed against the rod, so as to undergo a rotation opposite to that of the string. In this case, a second signal emitter 31 is provided, which is secured to the non-rotating part (e.g., to the upper trolley 6) and which is arranged in the proximity of a ring secured to the rod, provided with one or more relief members or teeth 32'. At the passage of each of such relief members, the sensor is excited, which sensor emits a signal which is used to correct the angular reference, thus eliminating possible sliding errors accumulated by the first emitter 20. The system herein described offers the advantage to install an emitter of a continuous type 20, since it is not more excited impulsively by the presence or absence of the projections. Therefore, in this case it is possible to adopt signal modulation techniques which can not only change the rate between two limit values, but which can manage all the transients as a function of time.

Figure 14:
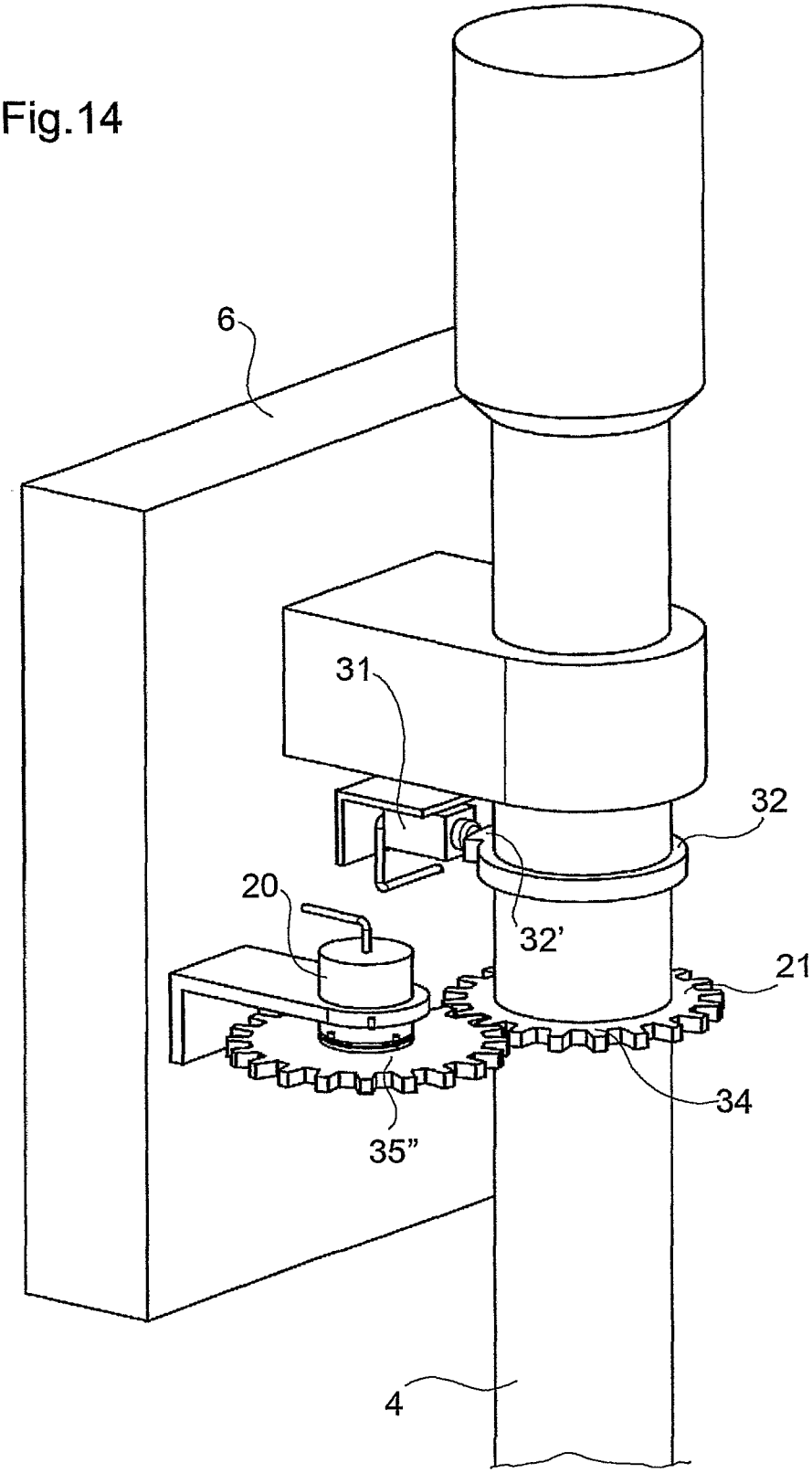
Figure 15:
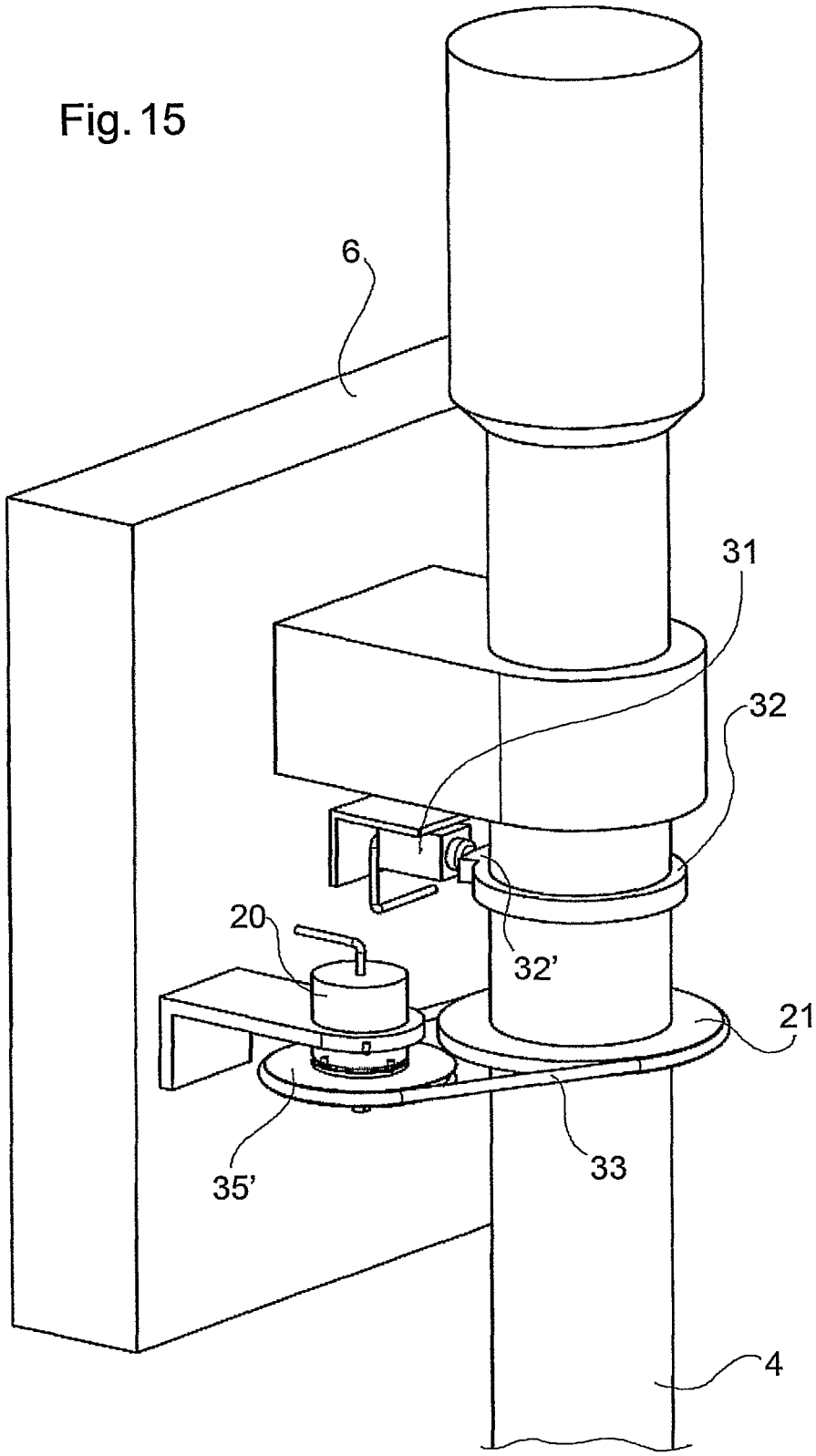

In other preferred embodiments, illustrated in FIGS. 14 and 15, the detecting device of the rod angular position includes a gear mechanism 34 (FIG. 14), or it comprises a flexible transmission means, such as a chain 33 (FIG. 15), which receives the motion by a member rotating integrally to the rod or anyhow timed therewith. In this case also it is possible to install different types of encoders 20, such as those based on the characteristic of a potentiometer to emit an electric signal proportional to the position taken by its rotor. The modulation of the rod angular motion allows obtaining consolidated soil columns having horizontal sections more or less compressed and elongated, of virtually any shape composed of circular sectors of different radiuses. In a still different embodiment, not illustrated, a signal indicative of the instantaneous angular position of one of the monitor nozzles is transmitted by an emitter constrained to the monitor to a receiver mounted on the trolley. The picked up signal is transmitted to the processing and control means, which adjust the rotational rate of the string of rods.

Figures 12A, 12B, 12C, 12D, 12E:
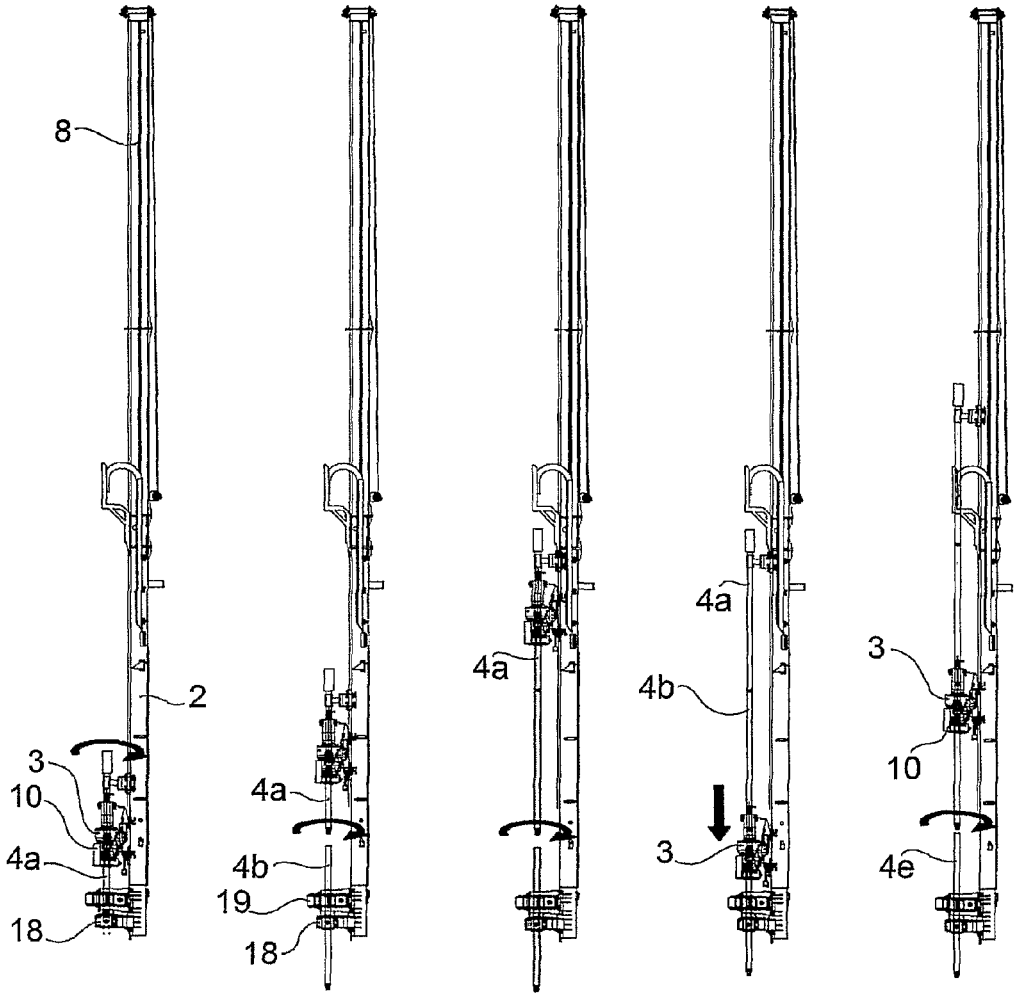
FIGS. 12A-12E are views representing a sequence for the assembling of the drill strings in which the restart manoeuvre is apparent.

In FIGS. 12A-12E a loading sequence of the rods is illustrated. In FIG. 12A, the rotary head 3 is lowered to the base of the antenna 2, in the position 3' (See FIG. 3A), and subsequently the supplying head 7 is screwed on top of a first rod 4*a*, located through an auxiliary equipment, such as a crane or elevator, not illustrated, and is secured to the upper trolley 6. The through clamp 10 is closed, that is, the jack is actuated so that the wedges clamp the rod and make it integral to the clamp. A second clamp 18, mounted at the mast base, is opened to axially free the rod; the rotary is lifted, and the rod 4*a* is lifted therewith. A second rod 4*b* is arranged and locked in the mast upper clamp (FIG. 12B); then, the rotary is lowered to screw the second rod 4*b* to the rod 4*a* previously mounted to the rotary. These screwing operations are performed by means of a screwing-unscrewing device 19 mounted just above the clamp 18. Once the rods 4*a* and 4*b* have been screwed one to the other, the mast clamp is opened again, and the rotary head is lifted again, together with the rods 4*a* and 4*b*. This sequence of operations is repeated until the rotary reaches the lowest end stroke thereof along the mast (FIG. 12C). In this moment, a restart step of the rods can be performed. The rods are clamped in the mast clamp. The through clamp is opened, and the rotary is lowered to the lowermost end stroke thereof 3', at the base of the mast 2 (FIG. 12D). Then the through clamp can be closed again on the last mounted rod, the mast clamp 18 can be unlocked, the rotary with all the rods already screwed can be lifted again, and then a new rod 4*e* can be arranged in the mast clamp, continuing until when the upper trolley 6 arrives in the proximity of the top of the mast extensions 8.

From the above-described sequence, it shall be apparent how the functions of the through clamp are to allow both the locking and the free sliding of the rod. Therefore, the simpler and commonest locking system is implemented by means of friction systems which connect the through clamp to the smooth cylindrical outer surface of the rod. This coupling is subjected to relative rotations and relative sliding movements due to the direct action of the operational loads, due to the actuation system being not always efficient, and the wear status of the parts which are in direct contact.

These angular sliding movements between wedges and rod being a normal occurrence, it shall be apparent that the angular reference of the rod, thus of the nozzle integral thereto, is lost, and the detecting of the angular position becomes inaccurate if the reading is taken on a member integral to the rotary. This causes a longer rotation at the treatment axis, thus generating reductions in the overlapping between treated soil elements, which should be mutually secant but which, as the error increases, can be released one from the adjacent one.

The present invention allows implementing deep columns of non-circular shape, while controlling the rod angular rotation, thereby of the nozzle(s) position. The through clamp allows increasing the treatment depth, while keeping the ability to direct the consolidating jet to the desired direction. In economical terms, this system allows time savings; in fact, the angular rotation is not kept at a constant angular rate for a complete turn, but at least in two sectors, the width which depends on the desired result, rotation is accelerated. Furthermore, consolidating material savings are achieved, since the injected volume is much lesser relative to the corresponding cylindrical column, and such advantageous effects proportionally increase with the column depth which is possible to increase by using the through clamp.

From an implementation standpoint, technological fields are known, in which it is required that the drilling and related jet grouting treatment are performed in an excavation direction which approximates to the horizontal. In this case, the drilling machines which are used can be both those of the type illustrated in the Figures, but operating with a mast 2 rotated relative to the vertical, or machines dedicated to an application in tunnels, generally known as positioners, which have masts dedicated and moveable to a direction which is parallel to the tunnel axis.

In this context too, the need to perform columnar treatments by using extensions and through clamp can be required, with the aim of implementing deep drilling operations. The above-described invention can apply to this type of works also, without any modifications to what has been described being needed.

The invention claimed is:

1. A jet-grouting equipment for forming consolidated soil columns having a non-circular cross-section, comprising:

a mast;

a rotary, translatable along an axis parallel to the mast and controllable upon rotating around said axis, and sliding along the mast;

a string of cylindrical hollow rods passing through the rotary and overhung from the rotary, the string having an overall length greater than a rotary stroke along the mast, said string being temporarily unlockable from the rotary by a mast clamp mounted at the mast base;

supplying means for injecting a consolidating fluid grout into the soil through the string of hollow rods;

a rotor directly secured to one of the rods of the string, the rotor being operatively coupled to at least one signal generating device, said signal generating device is mounted to a non-rotating part of a trolley of the jet-grouting equipment and is adapted to generate an electric signal indicative of an instantaneous angular position of the rotor;

means for varying rotational speed of the rotary in at least one predetermined angular range around said axis, using said electric signal as a control signal for varying the rotational speed of the rotary as a response to the instantaneous angular position of the rotor; and a through clamp, mounted to a rotatable mandrel of the rotary, provided with locking means which can be activated to clamp a rod and make the rod integral to the rotary, and which can be deactivated to release the rod to allow the rotary to move relative to the rod.

2. The equipment according to claim 1, wherein the through clamp includes:

a body with a cylindrical cavity defining a passage for the rods, a plurality of blocks angularly distributed around the cavity and moveable to radially innermost positions to at least partially project into said cavity to engage and clamp an outer surface of the rod, at least one body having a tapered or conical or inclined surface relative to said axis and acting on the blocks; and at least one actuator to move the body or the bodies to displace the blocks to said radially innermost positions.

3. The equipment according to claim 1, wherein the through clamp has relief surfaces adapted to couple with corresponding interface surfaces of the rotary mandrel, to transmit the rotational motion therefrom to the through clamp.

4. The equipment according to claim 1, wherein the through clamp has a surface located at the interface with the rotary mandrel and oriented transversally to said axis to transmit axial thrust stresses to the mandrel.

5. The equipment according to claim 1, wherein the through clamp is connected to the rotary mandrel through axial connection means to transmit axial pulling stresses to the mandrel.

6. The equipment according to claim 1, wherein the rotor includes at least two angular sectors, the mutual angular position of which is adjustable.

7. The equipment according to claim 6, wherein the rotor comprises two rings which can be secured on a rod, and wherein each ring has a respective pair of diametrically opposite angular sectors.

8. The equipment according to claim 7, wherein at least one of the two rings can be secured to the rod through removable fastening means.

9. The equipment according to claim 1, wherein a rod transfers rotational motion to at least one driven rotor having an axis substantially parallel to that of the string of rods, and operatively associated to the signal generating device.

10. The equipment according to claim 9, wherein the rod and the driven rotor are directly coupled through toothed wheels.

11. The equipment according to claim 9, wherein the rod and the driven rotor are indirectly coupled through a toothed belt.

12. The equipment according to claim 9, further comprising at least a second signal generating device emitting at least one signal at each turn of the rod, with which the possible errors accumulated by the first signal generating device are zeroed.

13. The equipment according to claim 1, wherein the signals are sent to a control unit for recording, displaying, and processing the treated signals.

14. The equipment according to claim 1, wherein the signal generating device is fixed above the rotary.

* * * * *